United States Patent [19]

Nishimoto et al.

[11] Patent Number: 5,074,930

[45] Date of Patent: Dec. 24, 1991

[54] METHOD OF MAKING NON-ORIENTED ELECTRICAL STEEL SHEETS

[75] Inventors: Akihiko Nishimoto; Yoshihiro Hosoya; Kunikazu Tomita; Toshiaki Urabe; Masaharu Jitsukawa, all of Tokyo, Japan

[73] Assignee: NKK Corporation, Tokyo, Japan

[21] Appl. No.: 477,840

[22] PCT Filed: Mar. 9, 1989

[86] PCT No.: PCT/JP89/00261

§ 371 Date: Apr. 6, 1990

§ 102(e) Date: Apr. 6, 1990

[87] PCT Pub. No.: WO89/08722

PCT Pub. Date: Sep. 21, 1989

[51] Int. Cl.[5] ..... C21D 8/12

[52] U.S. Cl. ..... 148/111; 148/2

[58] Field of Search ..... 148/14, 112, 2

[56] References Cited

U.S. PATENT DOCUMENTS

| | | | |
|---|---|---|---|
| 4,661,174 | 4/1987 | Miyoshi et al. | 148/111 |
| 4,666,534 | 5/1987 | Miyoshi et al. | 148/111 |
| 5,009,726 | 4/1991 | Nishimoto et al. | 148/112 |

*Primary Examiner*—R. Dean

*Assistant Examiner*—George Wyszomierski

*Attorney, Agent, or Firm*—Lemack & Lemack

[57] ABSTRACT

This invention is to save the energy by heating a slab at high temperature for producing non-oriented electrical steel sheets having excellent magnetic properties uniform over the full length thereof, without carrying out a long soaking, for which a continuously cast slab having a specified chemical composition is heated at a high temperature, and a heat cycle is then defined such that the slab is passed twice nearly around precipitation noses, thereby to coarse the AlN precipitates over the full length of the slab, and the slab is annealed under a specified condition after the hot rolling so that AlN is coarsened and the ferrite grains recrystallize and grow.

1 Claim, 1 Drawing Sheet

* Equivalent to cold slab :
Difference of $W_{15/50}$ less than 0.1 w/kg
Difference of $B_{50}$ less than 0.02T Inferior to cold slab :
Difference of $W_{15/50}$ more than 0.1 w/kg
Difference of $B_{50}$ more than 0.02T

* Equivalent to cold slab :
Difference of $W_{15/50}$ less than 0.1 w/kg
Difference of $B_{50}$ less than 0.02T Inferior to cold slab :
Difference of $W_{15/50}$ more than 0.1 w/kg
Difference of $B_{50}$ more than 0.02T

METHOD OF MAKING NON-ORIENTED ELECTRICAL STEEL SHEETS

TECHNICAL FIELD

This invention relates to a method of making non-oriented electrical steel sheets.

BACKGROUND OF THE INVENTION

As important factors of governing magnetic properties of electrical steel sheets, sizes and dispersing conditions of AlN and MnS precipitates in steels are taken up. This is why these precipitates themselves become obstacles to movements of magnetic domain walls and deteriorate not only the magnetic flux densities under a low magnetic field but also the iron loss, and in addition they hinder grain growth during recrystallization annealing, and immature grain growth thereby of ferrite grains give bad influences to developments of recrystallization texture preferable to the magnetic properties.

Coarser precipitates are preferable for grain boundary migration and magnetic domain walls during magnetization. It is important to provide the precipitations and coarsenings of AlN or MnS before the recrystallization annealing in the processes of making the electrical steel sheets.

For saving energy, it is desirable to make use of the sensible heat of the continuous cast slab by avoiding the slab temperature from going down and carrying out a hot rolling after a brief heating of the high temperature slab. However, since such a process takes an extremely short time for the slab cooling and heating in comparison with a process of reheating a cold slab as ordinarily done, a coarse precipitation of AlN taking place is not prospective.

Therefore, it has been proposed, for example, in Japanese Patent Laid-Open Nos. 108,318/77 and 41,219/79 to carry out a brief soaking before hot rolling the slab so as to coarsen the precipitation of AlN therebetween as said, and then reheat the slab to reduce a milling load of the hot rolling and to uniformalize the slab temperature for avoiding deterioration of the shape of the hot rolled sheet.

However, there arise problems, since the conventional processes require the soaking about 1000° C. for more than 40 min to coarse precipitation of AlN, surface properties are deteriorated by occurrences of scales in such a period, a cover should be needed for the soaking, so that an operating efficiency is lowered by attaching and removing the cover. Further, this process could not avoid non-uniformity of the temperature due to positioning of the slab, and accordingly the magnetic properties become non-uniform by non-uniformity in coarsening of AlN precipitates.

DISCLOSURE OF THE INVENTION

The present invention has been realized in view of such circumstances, where the energy is saved by brief heating the slab while it has the high temperature for usefully utilizing the sensible heat of the slab, a heat cycle of the slab is optimized, thereby enabling to coarsen the AlN precipitates in a period of short time, which has not been expected in the prior art.

That is, the invention comprises cooling down a slab after continuous casting between 700° and 900° C., heating it in a heating furnace for more than 5 min between 1000° and 1100° C., hot rolling and coiling a steel band lower than 650° C., said slab containing C: not more than 0.005 wt %, Si: 1.0 to 4.0 wt %, Mn: 0.1 to 1.0 wt %, P: not more than 0.1 wt %, S: not more than 0.005 wt %, Al: 0.1 to 2.0 wt %, balance being Fe and unavoidable impurities; annealing it, after pickling, at temperature of 800° to 1000° C. for a period of time satisfying $$\exp(-0.020T+20.5) \leqq t \leqq \exp(-0.022T+25.4)$$

herein,

T: soaking temperature (° C.)

t: soaking time (min), carrying out cold rollings of once or more than twice interposing an intermediate annealing and final continuous annealing at range of temperature between 850° and 1100° C.

DETAILED DESCRIPTION OF THE INVENTION

Figure 1:
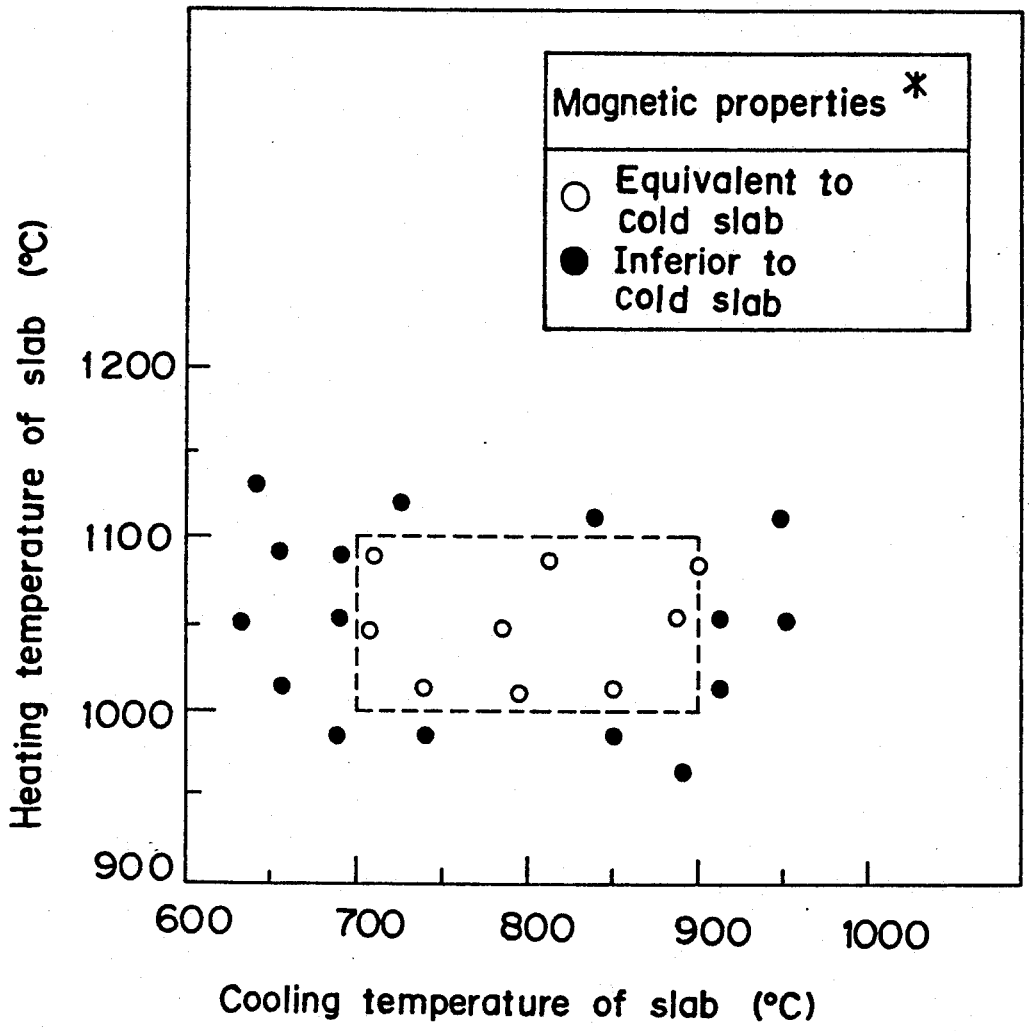
FIG. 1 shows influences of cooling temperature of a slab after casting and heating temperature of the slab on magnetic properties of a product.

In the invention, the operation is performed with the cooling after continuous casting between 700° and 900° C., the heating in the heating furnace for more than 5 min between 1000° and 1100° C., and the hot rolling on the slab containing C: not more than 0.005 wt %, Si: 1.0 to 4.0 wt %, Mn: 0.1 to 1.0 wt %, P: not more than 0.1 wt %, S: not more than,0.005 wt %, Al: 0.1 to 2.0 wt % balance being Fe and unavoidable impurities.

The coarse precipitation of AlN cannot be smoothly accelerated by only maintaining the slab at the high temperature, because nucleation frequencies of the precipitates are low at the high temperature, and the nucleation is a rate-controlling process. Therefore, in the invention, the slab is cooled nearly to a temperature where AlN precipitation begins to occur, and is then heated, whereby the slab is passed through the AlN precipitation temperature twice during cooling and heating to cause the AlN precipitates nuclei of proper amounts. Thus, if the slab is heated at the high temperature where a diffusion is fast, that is, AlN grows rapidly, the coarsening of AlN precipitates can be markedly accelerated during heating. Further, since AlN grows while uniformalizing the temperature of the slab by the heating, the uniform and coarse precipitation may be accomplished over a full length of the slab.

For having the above mentioned activity, it is necessary to cool the slab after the casting to the temperature of 700° to 900° C. If the slab is cooled down to less than 700° C., too long a time is passed around the AlN precipitation temperature, the nuclei generate too much, and the magnetic properties are deteriorated by fine precipitates of AlN. Besides, the heat energy required for the heating is increased and the saving energy will be minus. On the other hand, if the cooling temperature is higher than 900° C., too short a time is passed around the AlN precipitation temperature and the generation of the nuclei will be immature.

The slab is heated 1000 to 1100° C. after cooling, and if the heating temperature is less than 1000° C., the growing speed of AlN is slow and a long time is taken to coarsening of the precipitates and the milling load is increased during the hot rolling, accordingly. Heating at higher than 1100° C. is unpreferable in view of resolution of the once generated nuclei and saving the energy. If the heating time between 1000° and 1100° C. is less than 5 minutes, the coarsening of AlN precipitates is insufficient and the magnetic properties are deterirated. An upper limit of the heating time is not specified in the invention, but if it is longer unnecessarily, the economics will be expensive.

FIG. 1 shows the influences of cooling temperature of a slab after casting and heating temperature on the magnetic properties of the product. The continuous cast slab having the chemical composition shown in Table 1 was, after casting, cooled and heated (10 minutes) under various conditions, and then subjected to hot rolling—pickling—annealing—cold rolling—annealing under the conditions specified by the invention, and the magnetic properties of the produced electrical steel sheet was measured. For evaluating the magnetic properties, a standard electrical steel sheet was produced in that the slab of the same chemical composition was cooled to a room temperature (cold slab), re-heated to 1200° C., and then passed through the same process as said above, and the above mentioned electrical steel sheet was compared with the latter one.

As is seen from the same, in only the slab with cooling between 700° and 900° C. and heating between 1000° and 1100° C., the magnetic properties equivalent to these of the standard process (re-heating the cold slab) can be obtained.

After the cooling and heating mentioned above, the slab is hot rolled and coiled lower than 650° C. If the coiling temperature is higher than 650° C., scales inferior in the pickling properties are much generated and the scales are not perfectly removed by pickling. The remaining scales accelerate absorption of nitrogen by $N_2$ atmosphere during a subsequent annealing.

The hot rolled band is pickled and annealed.

The pickling is indispensable, because the scale accelerates absorption of nitrogen during annealing.

If the soaking temperature is set 800° to 1000° C. around the AlN precipitation temperature when the hot rolled band is annealed, it is possible to coarsen AlN precipitates, and accelerate recrystallization of ferrite grains and grain growth.

If the soaking temperature is less than 800° C., AlN is not made fully coarse, while if it exceeds 1000° C., the ferrite grains abnormally grow, and surface defects as ridges appear when the cold rolling and the recrystallization annealing are performed.

It is seen that the soaking t (min) should satisfy a following condition in relation with the soaking temperature T (° C.)

$$\exp(-0.020T+20.5) \leqq t \leqq \exp(-0.022T+25.4).$$

That is, for full coarsening of AlN and recrystallization and ferrite grains growth at which the present invention aims, $t \geqq \exp(-0.020T+20.5)$ must be satisfied. If the soaking time t (min) exceeds $\exp(-0.022T+25.4)$, the ferrite grains grow abnormally higher than 900° C., and the magnetic properties are deteriorated by formation of nitrided layer below 900° C.

The steel band which has passed the hot rolling and the annealing steps, is performed with the cold rolling of once or more than twice interposing the intermediate annealing, and the final annealing is done between 850° and 1100° C.

If the soaking temperature in the finish annealing is less than 850° C., a desired excellent iron loss and the magnetic flux density could not be obtained. But if it exceeds 1100° C., the operation is not practical in view of passing the coil and the energy cost, and in addition the iron loss is increased by the abnormal grain growth of ferrite.

A next reference will be made to reasons for limiting the steel composition.

C is set not more than 0.005 wt % when producing a steel slab so as to secure the ferrite grain growth by lowering C during heat treatment of the hot rolled band and affect coarsening of AlN via decreasing of the solubility limit of AlN accompanied with stabilization of ferrite phases.

Si of less than 1.0 wt % cannot satisfy the low iron loss due to lowering of proper electrical resistance. On the other hand, if it exceeds 4.0 wt %, the cold rolling is difficult by shortening of ductility of the steel.

Mn is required to be at least 0.1 wt % for the hot workability, but Mn of more than 1.0 wt % deteriorates the magnetic properties.

Since too much P spoils grain growth and invites deterioration of the magnetic properties, the upper limit is determined to be 0.1 wt %.

The upper limit of S is specified for improving the magnetic properties by decreasing an absolute amount of MnS. If S is set below 0.005 wt %, it may be decreased to a level negligible of bad influences of MnS in the direct hot rolling.

Al of less than 0.1 wt % cannot fully coarsen AlN and nor avoid fine precipitation of AlN. If exceeding 2.0 wt %, effects of the magnetic properties are not brought about, and a problem arises about weldablity and brittleness.

Depending upon the present invention, it is possible to save the energy by utilizing the sensible heat of a slab for carrying out the hot rolling, and produce the non-oriented electrical steel sheet having the magnetic properties uniform over the full length equivalent to those obtained by the standard process (re-heating the cold slab), without the soaking of the slab for a long period of time before the hot rolling, and at low production cost.

EXAMPLE

The steel shown in Table 1 was undertaken with the continuous casting to produce a slab. The slab was cooled and transferred into the heating furnace for the given heating, and hot rolled to the thickness of 2 mm at the finish temperature of 820° C. and coiled at the temperature of 600° C. Said slab as an ordinary process was cooled to the room temperature to produce the cold slab, and re-heated to the temperature of 1180° C., hot rolled to the thickness of 2 mm at the finish temperature of 820° C., and coiled at the temperature of 600° C. These hot rolled bands were pickled and annealed for 180 min at 820° C. (the soaking time of the invention is 60 to 1570 min at 800° C.) and for 10 min at 950° C. (the soaking time of the invention is 5 to 90 min at 800° C.), and subsequently cold rolled to the thickness of 0.5 mm and finish annealed 950° C.×2 min.

Table 2 shows heat cycles of the slabs from the casting to the heating and the magnetic properties of the electrical steel sheets.

As is seen from the same, each of the heat cycles according to the invention shows the excellent magnetic properties equivalent to those of the ordinary cooled-reheated slab case.

TABLE 1

| C | Si | Mn | (wt %) P | S | sol. Al | N |
|---|---|---|---|---|---|---|
| 0.0032 | 2.71 | 0.18 | 0.010 | 0.003 | 0.281 | 0.0018 |

TABLE 2

| No. | Ending temperature of air cooling the slab (temperature of entering into a heating furnace) | Heating temperature of the slab | Heating time of the slab | Annealing conditions of hot rolled bands | Magnetic properties $W_{15/50}$ | $B_{50}$ | Remarks |
|---|---|---|---|---|---|---|---|
| 1 | 810° C. | 1070° C. | 10 min | 820° C. × 180 min | 2.79 w/Kg | 1.68 T | Invention process |
| 2 | 620 | 1070 | 10 | 820° C. × 180 min | 3.35 | 1.64 | Comparison process |
| 3 | 1010 | 1070 | 10 | 820° C. × 180 min | 3.39 | 1.63 | Comparison process |
| 4 | 810 | 1190 | 10 | 820° C. × 180 min | 3.31 | 1.64 | Comparison process |
| 5 | Re-heating the cold slab to 1180° C. | | | 820° C. × 180 min | 2.78 | 1.68 | Ordinary process |
| 6 | 860 | 1040 | 15 | 950° C. × 10 min | 2.82 | 1.66 | Invention process |
| 7 | 860 | 940 | 15 | 950° C. × 10 min | 3.41 | 1.62 | Comparison process |
| 8 | 860 | 1040 | 2 | 950° C. × 10 min | 3.38 | 1.62 | Comparison process |
| 9 | Re-heating the cold slab to 1180° C. | | | 950° C. × 10 min | 2.80 | 1.67 | Ordinary process |

INDUSTRY APPLICABILITY

This invention may be applied to the method of making non-oriented electrical steel sheets.

What is claimed is:

1. A method of making non-oriented electrical steel sheets comprising continuous casting a slab, cooling said slab to a temperature range between 700° and 900° C.; heating in a heating furnace for more than 5 minutes at a temperature range between 1000° and 1100° C.; hot rolling and coiling at a temperature lower than 650° C.; said slab containing C: not more than 0.005 wt %, Si: 1.0 to 4.0 wt %, Mn: 0.1 to 1.0 wt %, P: not more than 0.1 wt %, S: not more than 0.005 wt %, Al: 0.1 to 2.0 wt %, the balance being Fe and unavoidable impurities; picking said slab, annealing said slab at a temperature of 800° to 1000° C. for a period of time satisfying:

$$\exp(-0.020T+20.5) \leqq t \leqq \exp(-0.022T+25.4)$$

wherein T: soaking temperature (° C.)

t: soaking time (min);

and carrying out one cold rolling or plural cold rollings having interposed therebetween an intermediate annealing and a final continuous annealing at a range of temperature between 850° and 1100° C.

* * * * *